US009335109B2

(12) United States Patent
Bensayan et al.

(10) Patent No.: US 9,335,109 B2
(45) Date of Patent: May 10, 2016

(54) REALTIME MEMORIALIZATION FIREARM ATTACHMENT

(71) Applicants: Maiquel Bensayan, Miami, FL (US); Ana Maria Fernandez, Miami, FL (US)

(72) Inventors: Maiquel Bensayan, Miami, FL (US); Ana Maria Fernandez, Miami, FL (US)

( * ) Notice: Subject to any disclaimer, the term of this patent is extended or adjusted under 35 U.S.C. 154(b) by 0 days.

(21) Appl. No.: 14/063,325

(22) Filed: Oct. 25, 2013

(65) Prior Publication Data

US 2015/0113851 A1 Apr. 30, 2015

(51) Int. Cl.

| | |
|---|---|
| ***F41G 1/00*** | (2006.01) |
| ***F41A 17/06*** | (2006.01) |
| ***F41A 19/01*** | (2006.01) |
| ***F41G 1/35*** | (2006.01) |

(52) U.S. Cl.
CPC ..... *F41A 17/063* (2013.01); *F41A 19/01* (2013.01); *F41G 1/35* (2013.01)

(58) Field of Classification Search
CPC ..... F41A 17/063; F41A 19/01; F41G 1/35
USPC ..... 42/117, 90; 200/61.19
See application file for complete search history.

(56) References Cited

U.S. PATENT DOCUMENTS 4,192,982 A * 3/1980 Schnizler, Jr. ..... H01H 3/04 200/322
4,276,458 A * 6/1981 Alter ..... H01H 11/0012 200/16 A
4,400,743 A * 8/1983 Takimoto ..... H04N 5/77 358/906
4,835,621 A * 5/1989 Black ..... F41J 5/10 352/95
4,879,438 A * 11/1989 Winchester ..... H01H 9/06 200/505
5,791,459 A * 8/1998 Hester ..... H01H 13/702 200/512
6,028,278 A * 2/2000 Fluman ..... H01H 1/20 200/512
6,363,223 B1 * 3/2002 Gordon ..... F41A 33/00 348/61
6,580,876 B1 * 6/2003 Gordon ..... F41A 33/00 348/61
6,587,152 B1 * 7/2003 Sharp ..... H04N 5/232 348/148
8,978,539 B2 * 3/2015 Teetzel ..... F41A 23/08 42/111
9,119,266 B1 * 8/2015 Lebens ..... F21L 4/027
9,143,663 B2 * 9/2015 Holmberg ..... A01M 31/00
(Continued)

*Primary Examiner* — Michelle R Clement
(74) *Attorney, Agent, or Firm* — Edmar M. Amaya, Esq.

(57) ABSTRACT

A firearm accessory that includes a body that is demountably attached to a firearm, the body containing: a camera; a microphone; a memory chip; a micro-controller operable to record a user's firearm activity into the memory chip as captured by the camera and the microphone; and, a trigger-switch mechanism demountably attached to a firearm-handle operable by a user's finger to turn the contents of the body on but not off. The body disposed on a firearm further includes a plurality of electronic components operable to: record audio, video, location, time, and date, at the time of usage of a firearm; and transmit the recorded a record audio, video, location, time, and date, outside of the body through a wire, a portable memory card, or wirelessly in realtime.

18 Claims, 10 Drawing Sheets

(56) References Cited

U.S. PATENT DOCUMENTS

2003/0056638 A1* 3/2003 Poole ..... F41H 9/10 89/1.11
2005/0268521 A1* 12/2005 Cox ..... F41G 1/38 42/130
2006/0086032 A1* 4/2006 Valencic ..... F41H 13/0018 42/70.01
2006/0191776 A1* 8/2006 Mizuno ..... G06F 1/1616 200/43.01
2007/0044365 A1* 3/2007 Deken ..... F41C 27/00 42/146
2007/0277420 A1* 12/2007 Newkirk ..... F41A 17/06 42/70.01
2007/0295199 A1* 12/2007 Elasic ..... F41H 5/08 89/36.06
2008/0010888 A1* 1/2008 Nerheim ..... F41H 13/0018 42/1.08
2008/0039962 A1* 2/2008 McRae ..... F41A 17/06 700/90
2008/0121097 A1* 5/2008 Rudakevych ..... F41A 19/58 89/28.05
2008/0233543 A1* 9/2008 Guissin ..... F41A 33/00 434/19
2011/0010981 A1* 1/2011 Wieland ..... F41G 1/473 42/114
2012/0106170 A1* 5/2012 Matthews ..... F41G 1/30 362/311.06
2012/0117848 A1* 5/2012 Cox ..... F41G 1/38 42/130
2013/0118341 A1* 5/2013 Brylev ..... F41G 3/00 89/1.11
2014/0059911 A1* 3/2014 Oh ..... F41C 23/22 42/16
2014/0103112 A1* 4/2014 Piazza ..... F41G 3/165 235/407
2014/0360072 A1* 12/2014 Lupher ..... F41G 1/38 42/69.01
2014/0360081 A1* 12/2014 Lupher ..... F41G 1/38 42/120
2015/0041538 A1* 2/2015 Teetzel ..... F41A 23/08 235/404
2015/0113851 A1* 4/2015 Bensayan ..... F41A 17/063 42/117
2015/0345907 A1* 12/2015 Varga ..... F41G 3/147 89/41.05

* cited by examiner

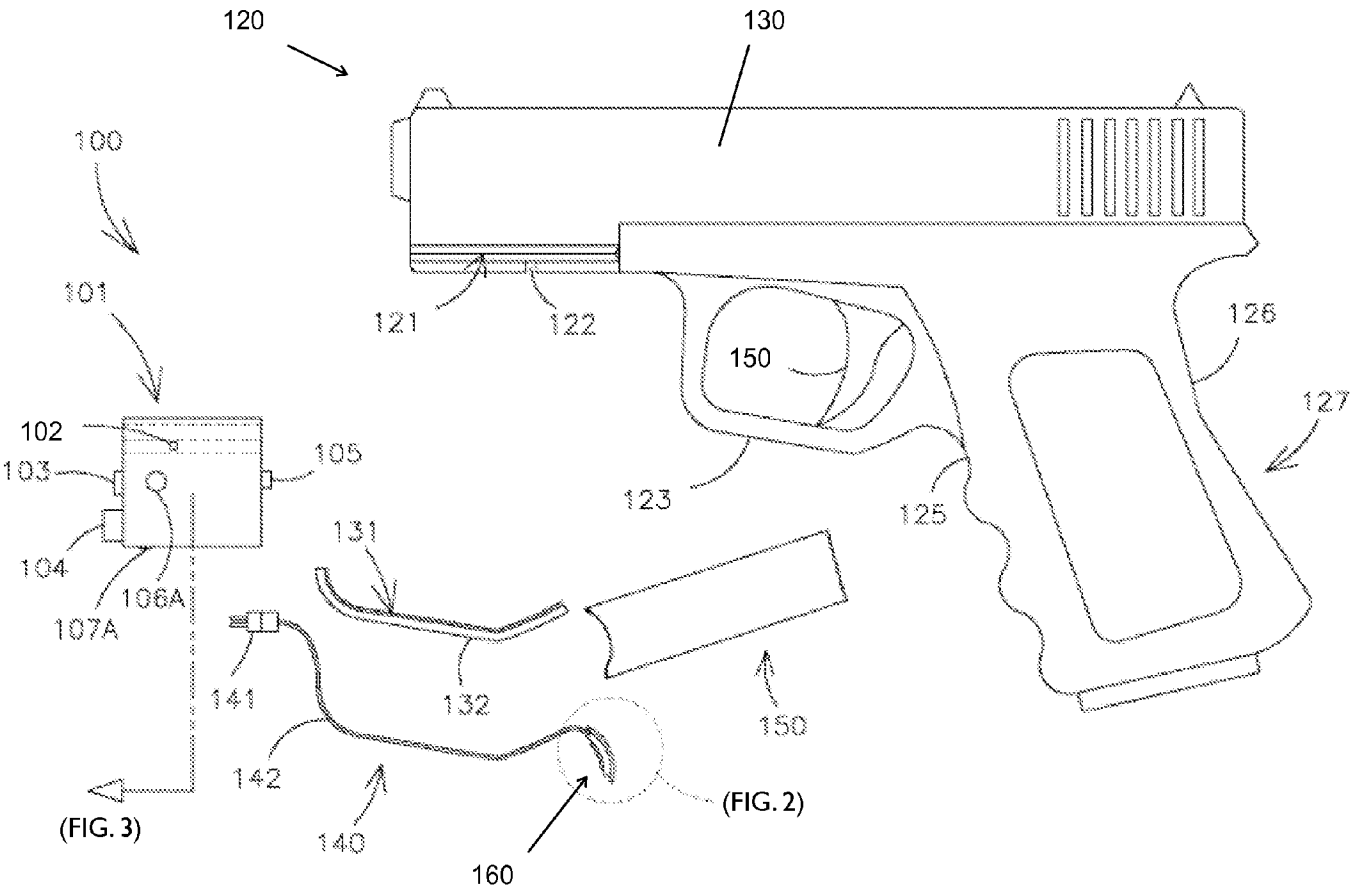
FIG. I

REALTIME MEMORIALIZATION FIREARM ATTACHMENT

CROSS REFERENCE TO RELATED APPLICATIONS

The present application is a Non-provisional Patent Application derived from Provisional U.S. Patent Application No. 61/859,268, filed on Aug. 16, 2013, which is hereby incorporated by reference in its entirety.

FIELD OF THE INVENTION

The present invention relates to the art of gun or weapon attachments and recording systems.

STATEMENT REGARDING FEDERALLY-SPONSORED RESEARCH AND DEVELOPMENT

Not applicable.

BACKGROUND OF THE INVENTION

The reenactment of a fatal shooting in court, to prove one's guilt or innocence, is one of the most difficult tasks to accomplish. Both for a defendant or the police, proving that a fatal shooting was an act of self-defense can be a daunting task. Usually, a shooting incident occurs in the heat of the moment, where persons rely on muscle impulse and habit training, and not on mental conscience. Most of the times, is difficult to re-create the fatal firearm incident after it occurred several months before trial and witnesses recollections, if any, are hazy and unreliable.

In cases related to firearm incidents, prosecutors usually rely on 911 calls to puzzle together what happened at the time of shooting. Nevertheless, 911 calls often never occur at the time of the shooting, but several minutes or hours after. Even when police needs to recount a shooting, the only video available is the one surrounding the police car, but if the assailant flees the police car, there is usually no record of the encounter.

Shootings captured on a camcorder could serve to the immediate preservation of evidence for trial. With video cameras in smartphones, Americans are increasingly showing audio and video recordings in court, nevertheless, most videos generally don't involve shootings. This is due to the difficulty to use a firearm and film with a cellphone at the same time.

Therefore, a need exists to overcome the problems with the prior art as discussed above.

SUMMARY OF THE INVENTION

The invention provides a Realtime Memorialization Firearm Attachment that overcomes the hereinafore mentioned disadvantages of the heretofore-known devices and methods of this general type.

With the foregoing and other objects in view, there is provided, in accordance with the invention, a firearm accessory including: a body demountably attached to a firearm, the body including: a camera, a microphone, a memory chip, and a micro-controller operable to record a user's firearm activity into the memory chip as captured by the camera and the microphone. The accessory also includes a trigger-switch mechanism operable to turn the contents of the body on.

In accordance with another feature, an embodiment of the present invention includes a GPS chip operable to ad location to the user's firearm activity, a laser sight, and an LED light disposed within the body.

In accordance with a further feature of the present invention, a wireless antenna chip is disposed within the body, and the wireless antenna chip transmits the user's firearm activity over a cellular tower into a server on the internet in realtime. The wireless antenna chip is operable to send and receive wireless signals comprising: Wifi, 802.11, MAC, Bluetooth, WLAN, and any combination thereof.

In accordance with a further feature of the present invention, the trigger-switch mechanism is one of capacitive, resistive, mechanical, and any combination thereof.

In accordance with the present invention, a method to memorialize the events surrounding a gun including the steps of: 1) providing an apparatus operable to record: audio, video, location, time, and date, at the time of usage of a firearm, and transmit the recorded audio, video, location, time, and date, outside of the body through a wire, a portable memory card, or wirelessly; and 2) transmitting the recorded audio, video, location, time, and date, wirelessly using a cellular tower to a telephone and to another computer on the internet.

In accordance with another feature, an embodiment of the present invention also includes a body disposed on a firearm, the body comprising a plurality of electronic components operable to record audio, video, location, time, and date, at the time of usage of a firearm; and transmit the recorded a record audio, video, location, time, and date, outside of the body through a wire, a portable memory card, or wirelessly.

In accordance with yet another feature, an embodiment of the present invention includes the plurality of electronic components are turned on or off by a trigger-switch mechanism and the plurality of electronic components are operable to transmit metadata, audio, GPS location, and video to a telephone using a cellular antenna.

In accordance with a further feature of the present invention, the portable memory card is flash memory card and the plurality of electronic components are operable to transmit metadata, audio, GPS location, and video to a telephone using a cellular antenna.

Although the invention is illustrated and described herein as embodied in a Realtime Memorialization Firearm Attachment, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Unless otherwise defined, all terms of art, notations and other scientific terms or terminology used herein are intended to have the meanings commonly understood by those of skill in the art to which this invention pertains. In some cases, terms with commonly understood meanings are defined herein for clarity and/or for ready reference, and the inclusion of such definitions herein should not necessarily be construed to represent a substantial difference over what is generally understood in the art. Many of the techniques and procedures described, or referenced herein, are well understood and commonly employed using conventional methodology by those skilled in the art.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the term "commands" refers to; direct, instruct, call on, require, manipulate, gives instructions in form of code or (digital or analog) signals, and control of an element over another.

As used herein in the specification and in the claims, the term "link" or "linked" refers to a connection, connector, coupling, joint or a relationship between two things or elements where one thing affects the other, both wireless, wired or in combination of both.

As used herein in the specification and in the claims, the term "responds" refers to an answer, reply, rejoin, retort, riposte, counter reaction, react, reciprocate, retaliate in form of code or (digital or analog) signals or any combination thereof.

As used herein in the specification and in the claims, the term "transmit" refers to pass-on, transfer data or information, in both digital or analog form, from one place or element to another both wireless, and wired or in combination of both.

As used herein in the specification and in the claims, the term "demountably attached" shall mean not permanently fixed, or removable.

As used herein in the specification and in the claims, the term "disposed within a body" shall mean to be partially within the body, i.e., not completely placed within the boundaries of the body, hence leaving some part protruding the exterior of the body.

As used herein in the specification and in the claims, the term "metadata" refers to "data about data content" or "content about content" thus metacontent. As non limiting examples it comprises, among others, audio, video, speech, image, communication, time, date, space, geophysical, sonar, radar, and Global Positioning System.

As used herein in the specification and in the claims, the term "wireless signals" or "wireless," refers to the transfer of information or data through the air.

As used herein in the specification and in the claims, the term "firearm," refers to any weapon not necessarily using gun powder. As a non limited example it includes: pistols, handguns, submachine guns, assault weapons, rifles, carbines, machine guns, shotguns, electric teasers guns, electro shock weapons, lethal weapons, semiautomatic or fully automatic weapons.

As used herein in the specification and in the claims, the term "realtime," refers to the continuously delivering and processing of data. Information/data that is delivered immediately after collection.

As used herein in the specification and in the claims, the term "connector," refers to both a female to male attachment for the transfer of data and power.

BRIEF DESCRIPTION OF THE SEVERAL VIEWS OF THE DRAWINGS

The foregoing summary, as well as the following detailed description of the invention, will be better understood when read in conjunction with the appended drawings. For illustrating the invention, the figures are shown in the embodiments that are presently preferred. It should be understood, however, that the invention is not limited to the precise arrangements and instrumentalities shown. In the drawings:

FIG. 1 is an exploited side view of the demountable firearm accessory including a body and a trigger-switch mechanism;

DETAILED DESCRIPTION OF THE INVENTION

Figure 4:
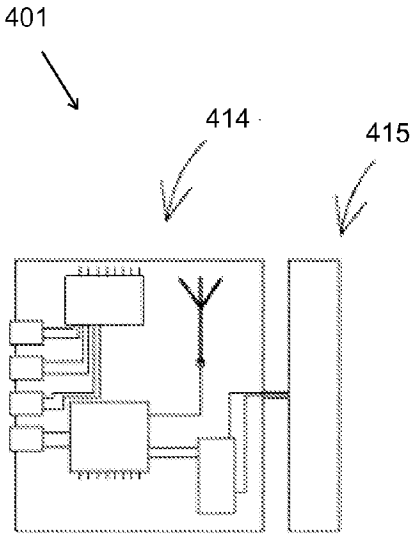
FIG. 4 is an exemplary composition in detail in schematic form of the contents of the circuits and components as shown within FIG. 3.

While the specification concludes with claims defining the features of the invention regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention depicts an inventive solution to the fore mentioned issues related to recording the surroundings of a weapon at the time of its firing. The invention includes a gun attachment apparatus that records data of a shooting and sends it over a network in realtime. The recording apparatus can be attached to the weapon itself, and can record information into different media to be extracted later or at the time of the use of the firearm. Law enforcement and citizens will rely on this gun "black box" to defend themselves to later accusations in court.

The invention herein includes an ingenious device and method to record, save, and transmit in realtime the surrounding events when a firearm is shot. Some of the environmental data to be recorded by the inventive device include, date, time, location, video, and audio. Furthermore, the device incorporates features such as LED lighting for night capture of video, night vision capabilities, and a laser sight for accurate shooting.

This invention will give the user, or shooter, the opportunity to present accurate evidence in court, judicial proceeding or to law enforcement authorities, since the gun was drawn from its holster. In any situation where the weapon is used, as long as the device is activated, the data within could be used to show what happened without the need for speculation. Another reason to use such data-recording is to memorialize the shooting activity and later retrieve for law enforcement training or to improve recreational shooting. Furthermore, the invention is capable of transmitting the recorded data wirelessly to a server online, in realtime for evaluation or training.

Because of the small size, the memorializing apparatus can be easily concealed. This device will be able to record day and night as long as there is enough battery charge. The device includes other features such as a camera, a laser sight, and ultra bright white LEDs, all incorporated into a single body.

FIG. 1, depicts an exploited side view of an embodiment of the invention herein. Here, demountable firearm accessory 100 includes the following general parts: a body 101 and a trigger-switch mechanism 140. The body 101, is demountably attached to a firearm 120. Body 101 could be made of injection molded plastic or extruded, forged, machined aluminum or other metals. Disposed within the body 101 are several electronic components that provide with the overall purpose of the invention herein.

Disposed within body 101 is a digital video camera 104, a digital microphone 103 (only the features protruding outside of body 101 are shown here). The firearm accessory 100 further incorporates a trigger-switch mechanism 140, wherein the trigger-switch mechanism 140 commands a micro-controller (not shown) inside the body 101 to capture video through the digital video camera 104, and sound through the digital microphone 103 and save it onto a memory chip (not shown).

FIG. 1 also depicts a handgun 120 that includes the following features: a firearm-handle 127, a barrel 130, a trigger guard 123, a trigger 150. The firearm-handle 127 further includes a back side 126 and a front side 125. It is intended for the firearm accessory 100 to be attached on the lower side of the handgun 120, hence, at the bottom of the barrel 130, on the trigger guard 123 and in the front side of the firearm-handle 127. It is envisioned that the firearm accessory 100 be placed on other parts of the hand gun 120, such as the top of the barrel 130 or at the bottom of the firearm-handle 127, and more.

The demountable firearm accessory 100 also includes, a plurality of control buttons, such as, 106A and 107A, capable of turning on and off the digital video camera 104, the digital microphone 103, and the other electronic components, both independently or jointly. One embodiment of the firearm accessory 100 also includes at least one external in input/output connector 105. Here, the side view of a female connector 105 can be seen, one of the purposes of the connector 105 is to link or connect to the trigger-switch mechanism 140 to the body 101.

In one embodiment of the invention, body 101 is demountable attached to firearm 120 by a frame-track 121 and by using notch 122 as a guide. Furthermore, the body is securely fastened with screw 102. Additional types of demountable fasteners that could be used to attach body 101 to gun 120, for the same purpose to achieve the same result are: clamps, magnets, adhesives, tapes and more. In another embodiment of the invention, the body 101 is attached to the firearm 120 with solder, hence the body is permanently fixed to the firearm. It is also envisioned that the body 101 could also be cast or forged in one-piece together with the firearm frame.

In one embodiment, the trigger-switch mechanism 140 further includes a trigger-switch actuator 160 (shown in detail view FIG. 2), cables 142, a male connector 141, an attachment band 150, a cable guide 132, and an adhesive band 131. The attachment band 150 holds the trigger-switch mechanism 140 by grabbing the firearm-handle 127, sometimes called the wrap-around grip, in both the back side 126 and the front side 125. The trigger-switch actuator 160 should be placed at the top front side 125 of the handle, where it gives it the most natural placement for a grip using the a finger, between firearm-handle 127 and the trigger guard 123.

According to the United States Shooting Academy, a handle's top front side 125 is where a person holding a gun should put the index finger out of the trigger 150. The top front side 125 is also where the trigger finger is kept off the trigger and outside the trigger guard 123 until the shooter have made a conscious decision to shoot. This location is where the trigger-switch actuator 160 should most naturally be located, but is also envisioned that other locations around the firearm-handle 127 could be used.

Figure 2:
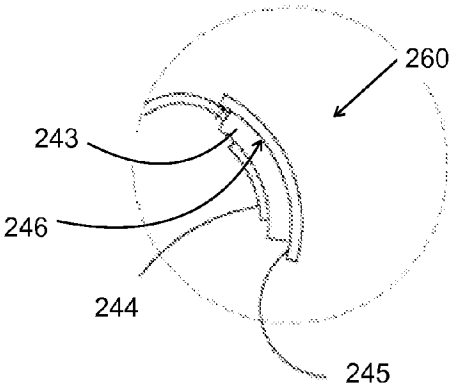
FIG. 2 is a detailed side view of the trigger-switch actuator.

In FIG. 2, a detailed side view of the trigger-switch actuator 260 is shown. FIG. 2 further includes a non conductive base 245, which is in intimate contact with the firearm-handle 127 (shown previously in FIG. 1). The trigger-switch actuator 260 further includes a switch button 244 and a button spacer 243. In one embodiment of the intention, the trigger-switch actuator 260 is mechanical, which means that the switch button 244, comprises a metal base and the button spacer 243 is a spring that allows for the switch button 244 metal base 247 to touch a similar metal trip 246 on the opposite side of the button spacer 243. As the electricity passes to metal trip 246 on the opposite side of the button spacer 243 a signal is produced for the micro-controller (not shown). The switch shown in FIG. 2 is a tactile switch 244 defined herein as a manually operated electro-mechanical device with one or more sets of electrical contacts connected to external circuits.

In another embodiment of the switch shown in FIG. 2, it closes or opens a set of contacts in accordance with the trigger finger movement or pressure. An applied electrical signal then determines whether the circuit is open or closed. Hence, current flows if the circuit is closed, registering a "1" in a transistor (ICs or any other electronic component) at the interface (not shown). Conversely, an open circuit retains a high voltage (and no current), registering a "0" at the transistor.

It is envisioned, that the electrical switch FIG. 2 could be any device used to interrupt the flow of electrons in a circuit. Switches are usually binary devices: they are either completely on ("closed") or completely off ("open"). The simplest type of switch is one where two electrical conductors are brought in contact with each other by the motion of an actuating mechanism. Further switches are more complex, containing electronic circuits able to turn on or off depending on some physical stimulus (such as light or magnetic field) sensed. In any case, the final output of any switch will be (at least) a pair of wire-connection terminals that will either be connected by the switch's internal contact mechanism ("closed"), or not connected ("open"). Already in the binary language of computers, these types of digital, or discrete, inputs and outputs (I/O) are much easier for microprocessor-based data acquisition systems to deal with than analog signals.

Here, a B3F-1000 from OMORON Electronics Tactile Switch without ground was used for the switch of FIG. 2. Other switch technologies used for the same purpose to accomplish the same result are capacitive switches. Capacitive or capacitive sensing technology uses an electrical field to detect the presence of a trigger finger as switch activation. When the trigger finger enters the field, the switch recognizes a change in the capacitance indicating an actuation, user interfaces with no moving parts. It is envisioned other switches that could be used for the same purpose and include inductive, magnetic, toggle switches, and resistive pushbuttons.

By pressing switch 260 in FIG. 2, a signal to the micro controller is sent to turn the camera and microphone "on" to begin recording, the same switch 260 in FIG. 2 does not place the camera and microphone in the "off" position. Once switch 260 is pressed, the recording will not stop unless another push button (on the body 100 previously shown in FIG. 1) is pressed for more than a few seconds. The LED lights and the laser will be turned on at the same time as the activation of the camera by switch 260.

One advantage of the invention herein, is that the recording will not stop once the activation switch 260 is pressed once. This feature will prevent that the user or shooter might press switch 260 again inadvertently. The user might turn the recording device off by accident if the user is shooting the gun, is under stress, and presses the switch 260. Therefore, the camera 104 (shown in FIG. 1) will continue to record the action regardless if the activation switch 260 is pressed multiple times. The only way to stop the recording, or deactivate camera 104 (shown in FIG. 1), is to press one of the side buttons, for example between about 2-30 seconds.

Another reason why the camera 104 (shown in FIG. 1) will not stop recording once the switch 260 is pressed, is because a user might be in a situation of stress or responding to a situation of danger. For example, a person is threatening to assault a user with a deadly weapon, but the user is trying to talk him by having a conversation. The user only needs to press switch 260 prior or at the time of the encounter with the assailant for the conversation to be recorded. If the user is not able to persuade the assailant into submission, and have to use his weapon, a justification for the shooting will be part of his recording, as well as the video of the shooting itself. This feature, turning on the recording device by using a single switch while the gun still in its holster, is of great advantage for the shooter when in a situation with little time to think.

Figure 3:
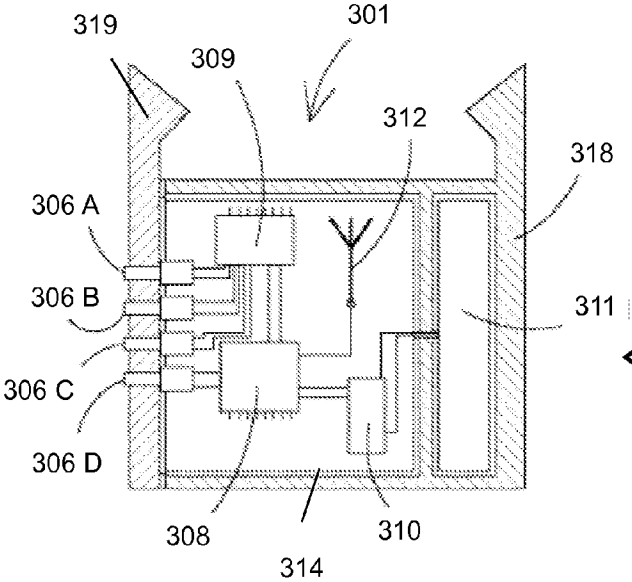
FIG. 3 is a frontal cross-sectional view of the body shown in FIG. 1, depicting the electronic components inside.

FIGS. 3 and 4 should be viewed together and are schematic representations of bodies 301 and 401 presented previously as reference number 101 in FIG. 1. FIG. 3 is a frontal cross-sectional view of body 101 in FIG. 1 showing the electronic components inside. FIG. 4 is an exemplary composition in schematic form of the electronic circuits and components 401 within body 301 in FIG. 3. Here in FIG. 4, the body 401 is divided into two hemispheres, the battery module 415, and the motherboard-chip module 414. The battery module 415 is separated from the motherboard 414 for easy replacement and to prevent unnecessary heating of the electronics.

The battery comprises a Lithium-ion polymer battery has a high power density that gives a long battery life in a light package. A lithium-ion battery (sometimes Li-ion battery or LIB) is a member of a family of rechargeable battery types in which lithium ions move from the anode to the cathode during discharge and back when charging. Li-ion batteries such as 414, use an intercalated lithium compound as the electrode material, compared to the metallic lithium used in non-rechargeable lithium battery. Here, in one embodiment, a HITACHI BLI-1260-1.4 Li-Ion Battery—Rechargeable Ultra High Capacity (between about 400 mAh to 1400 mAh) was used to manufacture the invention. It is envisioned that comparable rechargeable batteries could be used in the same way to achieve the same result.

Now in FIG. 3, hemispheres 318 and 319 are shown super imposing the battery module 415, and the motherboard-chip module 414 of FIG. 4 into body 301. The overall position of the electronic components within the body 301 can be seen. As showed in the cross-sectional diagram of FIG. 3, the body 301 further includes, a memory chip 308, the memory chip 308 records, in digital form, data of all the events surrounding this firearm 120 (shown previously in FIG. 1). Data of the shooting events include: environmental data such as type and speed of the bullets, frequency of the shooting, surrounding sounds, still photographs, moving video, and metadata such as GPS location, time, and date.

The memory chip 308 could be internal and or external. Internal means inside of body 301 hence non-removable and external means that it can be removed by a user, hence portable or demountably attached. The reason for using both types of memories is that if the internal memory chip becomes full and external memory chip is allowed to continue to store the data. Here, an internal memory 308 from MICROCHIP Technology EEPROM 256 k, was used. Similar chips that could be used for the same purpose, are RAM, ROM, DDR2, DDR3L, DRAM, SRAM, FIFO, EPROM, PROM, EEPROM, and any combination thereof.

The motherboard module 314 further comprises a micro-controller 309. Here a DS1314S+ from MAXIM Integrated Memory Controllers 3V Cntlr with a Lithium Battery Monitor was used. It is envisioned that other micro-controllers can be used to monitor and control: digital voice, digital video, battery, a wireless chip and metadata.

The motherboard module 314 also includes a built-in GPS chip 310. The GPS multichip module 310 is STA2058 from TESEO, Baseband STA5620 RF front-end with a complete embedded memory system Flash 256 KB+16 Kbyte and RAM 64 Kbytes and a 66-MHz ARM7TDMI 32 bit processor. Other similar GPS multi-chips are envisioned to give the geographical location to body 301. It is intended for the micro-controller 309 to tag video and audio recordings with date, time, and GPS location metadata and send it to the memory chip 308 (or removable portable flash memory card) and/or to the wireless communication chip-antenna 312. The wireless communication chip-antenna 312 is also disposed within body 301.

A wireless communication chip-antenna 312 that combines Wifi, 802.11, MAC, Bluetooth, and WLAN was utilized with the invention herein. One such chip used was DELL WIRELESS' DW1704 WLAN WiFi 802.11 b/g/n+Bluetooth Half-Height Mini-PCI Express Card—R4GW0. An alternative embodiment is to have individual chips for the different wireless protocols. The purpose of the chip-antenna 312 is to transmit wirelessly; digital sound, digital video, gps, metadata, and any combination thereof. This transmission will allow to another person to see in realtime; digital sound, digital video, metadata, and any combination using the aforementioned wireless technologies. The live transmission of images and sound from the perspective of a gun is one of the most ingenious features of this invention.

The motherboard 314 and its components depicted in FIG. 3, is controlled by a plurality of buttons (together numbered as 306 A-D) to select the individual features of the firearm accessory within body 301. Here, individually button 306A is an off/on switch to engage the system on/off, the 306B is a on/off switch to select the camera to record or not, the 306C on/off switch is a select the LED to turn on or not, and the 306D on/off switch is to select the laser-sight to turn on or not.

Figure 5:
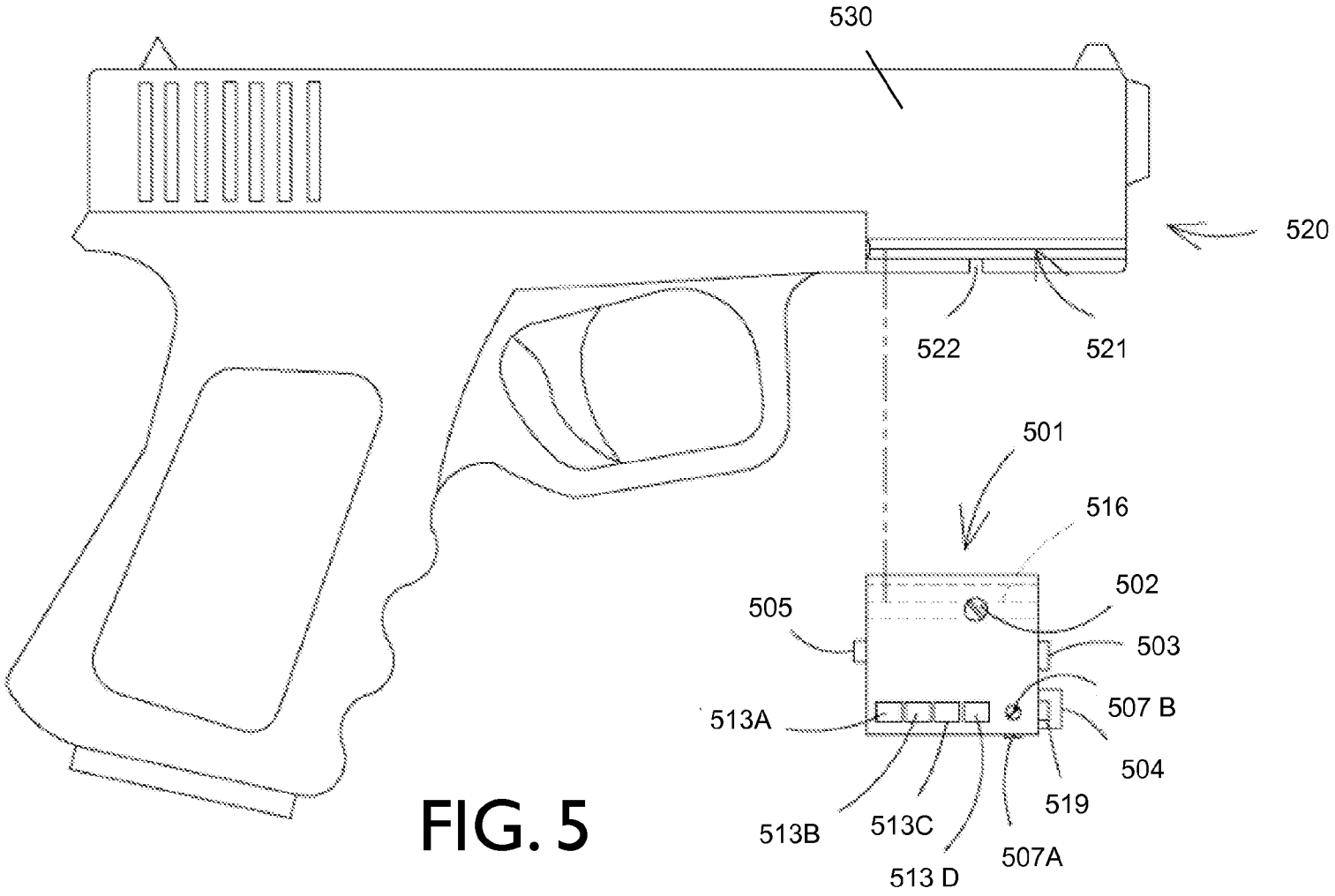
FIG. 5 is an exploited side view of the demountable firearm accessory including the details of the elements of the body.

FIG. 5, depicts a side view of invention body 501 and firearm 520 as it is installed at the bottom of the frame track 521 in front of firearm barrel 530 using notch 522. Here using internal track guide 516 attaches using frame track 521 body 501, and is fastened using screw 502. In FIG. 5, a side-view of the external components are shown as they extend out-of-body 501, namely, a camera 504, a laser 519, and a microphone 503.

The camera 504 used for this embodiment is a micro-camera from VFOXCHINA Shenzhen Vtek Technology Co., Ltd, is shown here as its lens protrudes out-of-body 501. This particular model comprises a built in microphone 503, and it is shown here as its front tip protrudes out-of-body 501. It is envisioned that a separate and independent microphone could be used by one skilled in the art to accomplish the same result of recording audio. A high definition HD camera, giving good quality video is preferred but not required. It is also envisioned that the camera includes an infra red (IR) spectrum lens for night vision purposes. Night vision both passive and active could be used to enhance night recording capabilities. The recording will be activated through switch 260 (showed in FIG. 2) which in turn is connected to male connector 141 (shown in FIG. 1), to female connector 505 that feeds in the signal to the micro-controller 309 (showed in FIG. 3).

In FIG. 5, the laser sight 519 is shown in a side view as the tip of the lens protrudes on the outside of the body 502. The laser sight 519 is used to assist the user to be able to quickly and accurately point the weapon at the target. The laser sight 519 helps a user guide shot on environments with poor light conditions, such as in darkened rooms or buildings, or at night. In order to adjust the direction of the laser beam, two screws 507A and 507B have been placed on the laser sight 519 device enclosure. The laser sight module 519 DE532-3-3-5 of BOB LASER Co., Ltd. Huanic Corporation was used, but other similar lasers such as CROSSMAN Laser Sight from different manufacturers could also be used.

Figure 6:
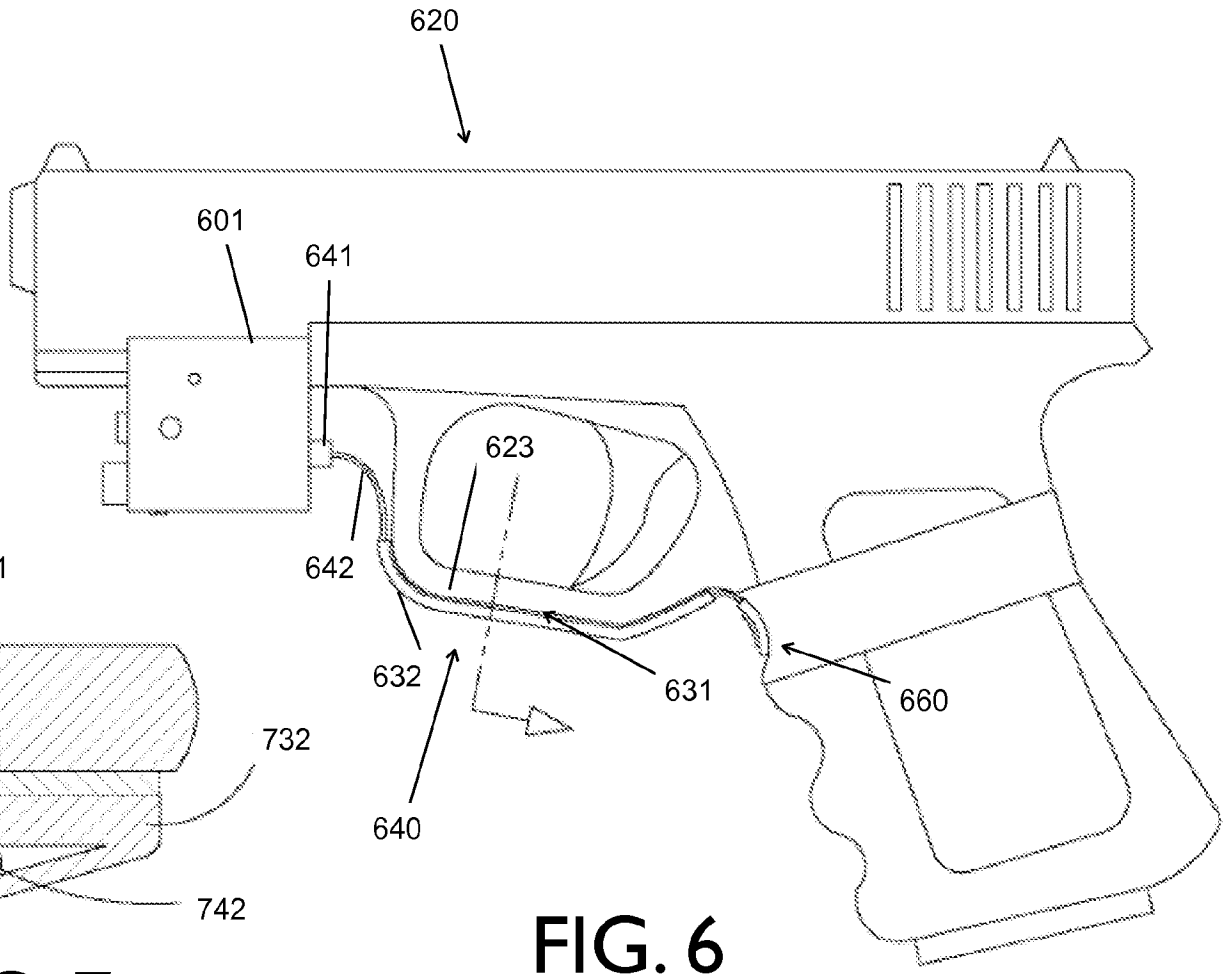
FIG. 6 is a side view of an embodiment of the demountable firearm accessory including the body and the trigger-switch mechanism.
Figure 7:
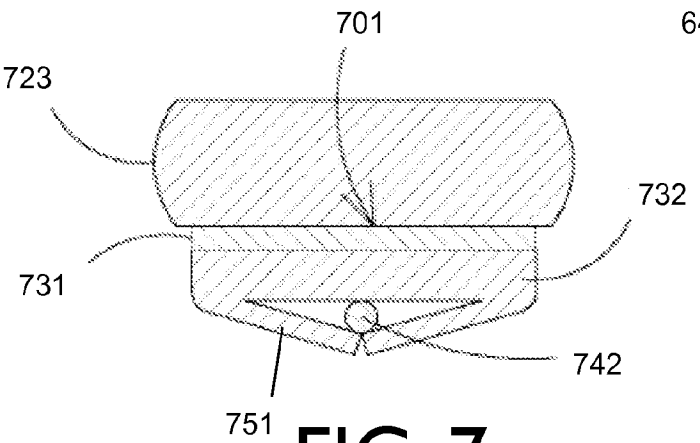
FIG. 7 is a frontal cross-sectional detailed view of the trigger-switch mechanism of FIG. 6.

FIG. 6 shows the trigger-switch mechanism 640 in a side view as is mounted on firearm 620. Here a cable 642 is placed within a cable guide 632, and by using an adhesive band 631 attached on the bottom of the trigger guard 623. The male connector 641, is the bridge or link that connects cable 642 and switch 660 to the circuits within body 601. FIG. 7 depicts a cross-sectional detailed view of the trigger-switch mechanism 640 of FIG. 6. Here in FIG. 7, the cable 742 is placed within a cable guide 732, and by using an adhesive band 731 attached on the bottom of the trigger guard 723. Cable guide 732 includes a set of wings 751 that allows removal of the cable 742 if it needs to be replaced.

Figure 8:
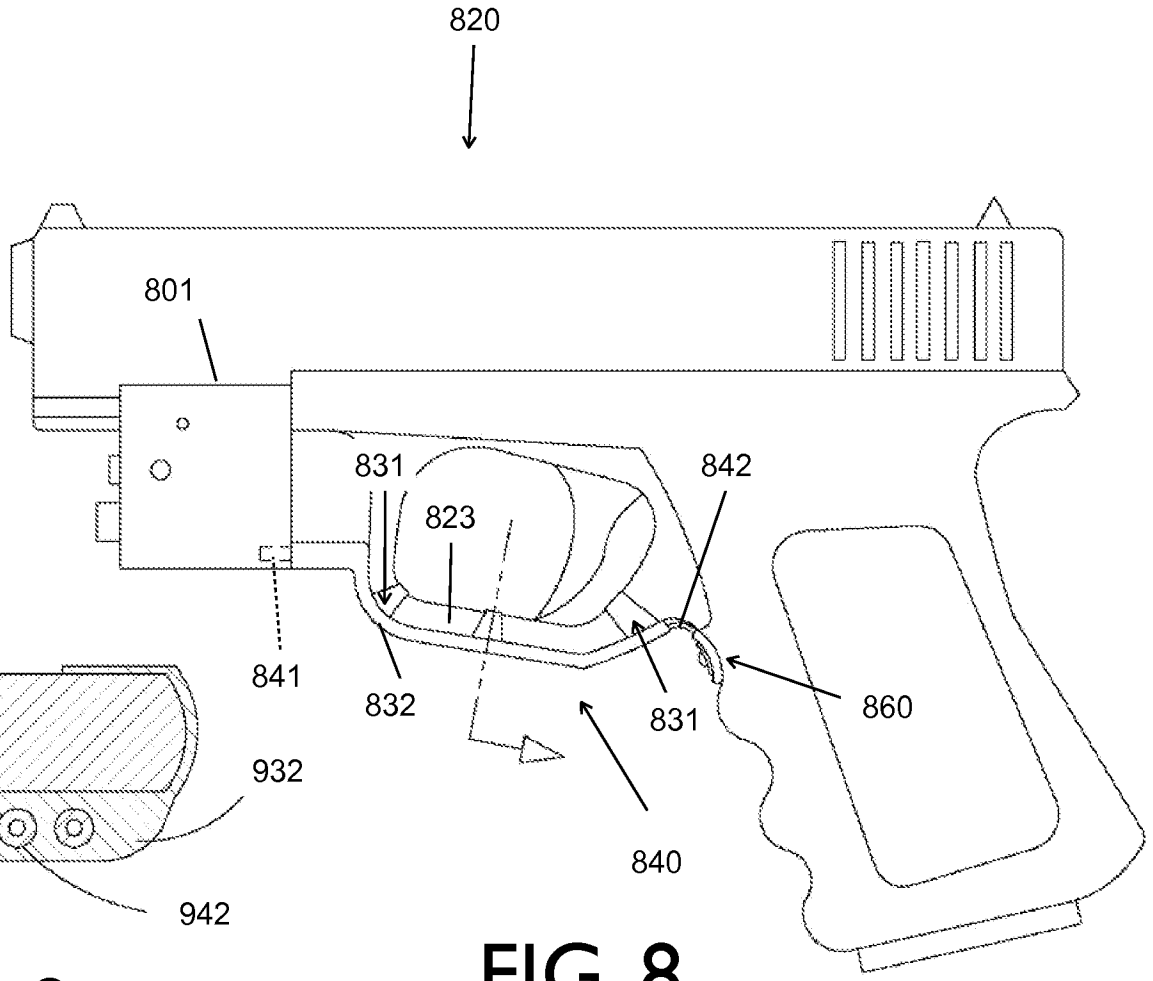
FIG. 8 is a side view of an embodiment of the demountable firearm accessory including the body and the trigger-switch mechanism.
Figure 9:
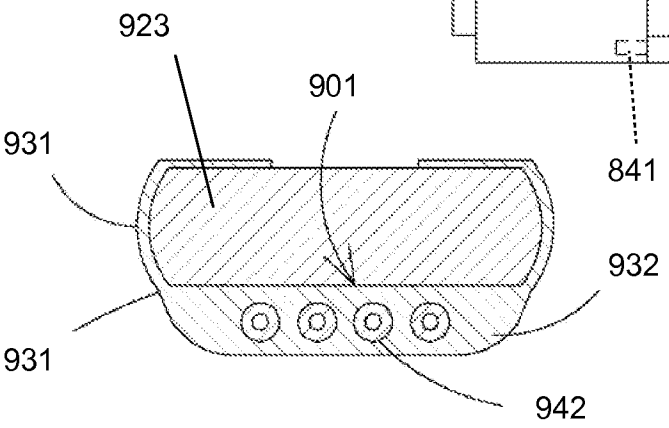
FIG. 9 is a frontal cross-sectional detailed view of the trigger-switch mechanism of FIG. 8.

In an alternative embodiment to the trigger-switch mechanism 640 previously shown in FIG. 6, here in FIG. 8, it shows the trigger-switch mechanism 840 in a side view as it is mounted on firearm 820 about trigger guard 823. Here the cable 842 is placed within a cable guide 832 that is made out of plastic material. Cable guide 832 is attached on the bottom of the trigger guard 823 by using demountable gripping wings 832. The male connector 841, is inserted into the circuit-board (not shown) within body 801. Now, in FIG. 9, it depicts a cross sectional detailed view of the trigger-switch mechanism 840 of FIG. 8. Here in FIG. 9, the cable 942 is molded inside cable guide 932, and by using demountable gripping wings 931 is attached on the bottom 901 of the trigger guard 923. Cable guide 932 includes a set of demountable gripping wings 931 that allow the removal of the entire trigger guard 923 if it needs to be replaced.

Figure 10:
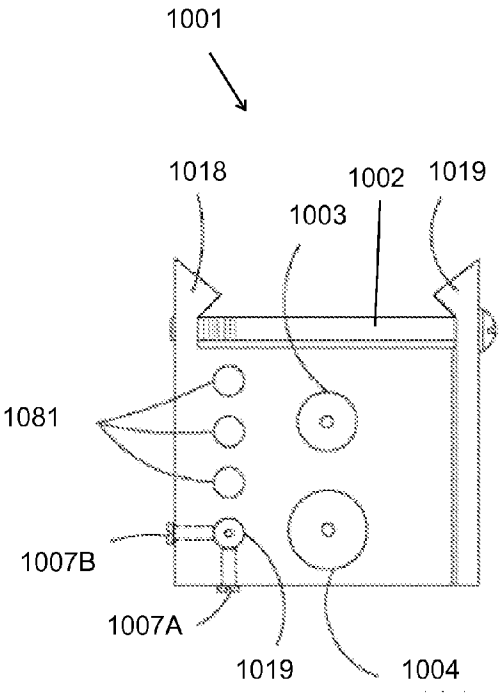
FIG. 10 is a frontal view of the body housing the electronics wherein both halves of the body are shown.

FIG. 10, is a frontal view of body 1001 housing the electronics wherein both halves, 1019 and 1018, can be seen fastened using screw 1002. Mostly disposed within body 1001 here is the digital video camera 1004, a digital microphone 1003, laser 1019, and two adjusting screws 1007A and 1007B. Here, three ultra white bright LEDs 1081 have been placed on a secondary circuit board (not shown). It is envisioned that one or more ultra white bright LEDs can be used. This allows for illumination of the immediate surrounding when filming in the dark and to help the clarity of the recordings. Furthermore, the illumination provided by the ultra white bright LEDs 1081 will improve the image of the video recording. The ultra white bright LEDs 1081 can also serve independently as an external light source instead of using a flashlight. One example of the bright LEDs 1081, used in the invention is a surface mountable component, ASMT-YTB7-0AA02 from AVAGO Technologies Standard LEDs—SMD RGB Full Color. Single color blue LEDs with phosphor or RGB/while LEDs could also be used.

Figure 11:
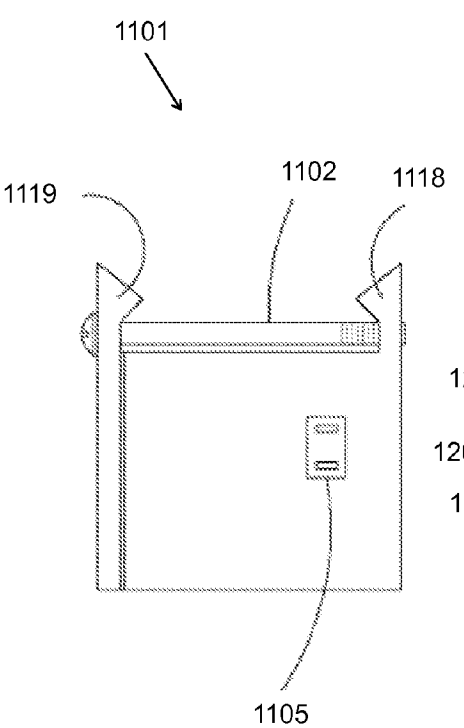
FIG. 11 is a back view of the body of FIG. 10, here, the female connector is shown.

FIG. 11 is a view of the rear body 1101, here, the female connector 1105 is shown. This female connector 1105 feeds in the signal to the micro-controller that is disposed within the body 1101. Female connector 1105 demountably couples to a male connector 105 (previously shown in FIGS. 1, 6, and 8). It is envisioned that the connection of body 1101 to switch mechanism 140 (shown in FIG. 1) could also be accomplished by the use of a permanent connection without the need for a connector at all.

Figure 12:
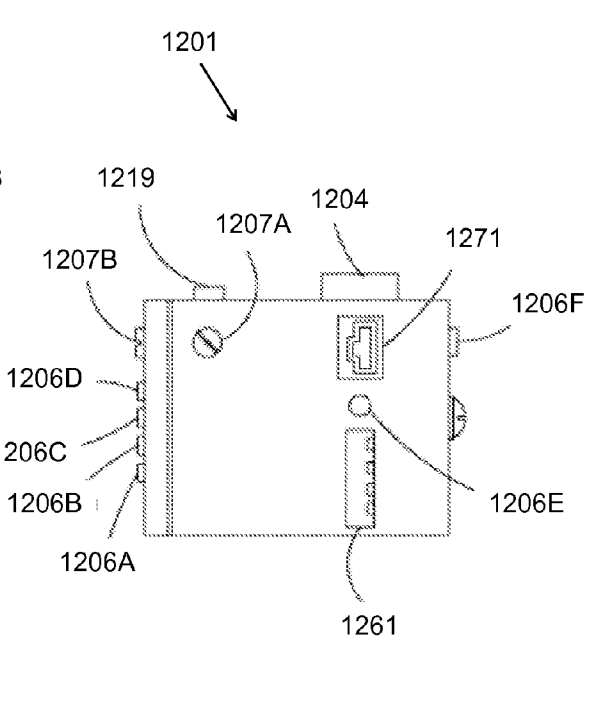
FIG. 12 is a bottom view of the body of FIG. 10, here, the Micro USB port is depicted, as well as the TF micro SD cards inlet.

FIG. 12 is the bottom view of invention body 1201, here, the on/off buttons 1206A, 1206B, 1206C, 1206D, 1206E and 1206F can be seen as well as the laser adjusting screws 1207A and 1207B. It further depicts the camera lens 1204 and laser lens 1219 as they protrude outside of body 1201. In this view the Micro USB port 1271 is depicted, and the TF micro SD card's inlet 1261.

Figure 13:
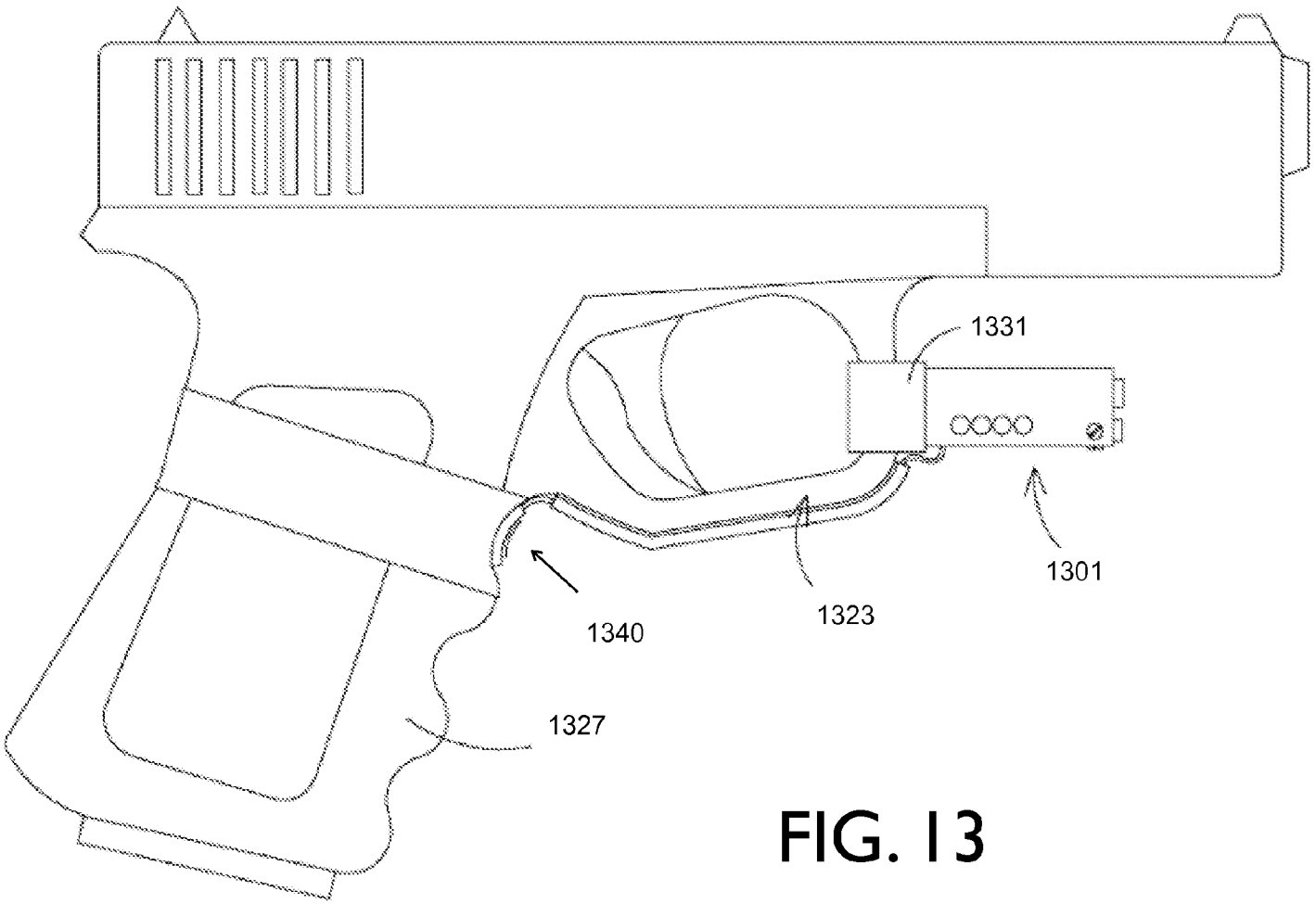
FIG. 13 is a side view of an embodiment of the demountable firearm accessory including the body and the trigger-switch mechanism.

FIG. 13 is an alternate embodiment of the firearm accessory 100 of FIG. 1. Here, in FIG. 13, a side view of the body 1301 is mounted onto the trigger-guard 1323 instead of on frame track on the bottom of the gun-barrel shown previously in FIGS. 1-8. In this alternative, the body 1301 could be mounted on the trigger guard 1323 or on something analogous to a trigger guard on any gun. Similarly, the device could also be mounted on any gun which has rail or something akin to a rail. It is important to note that the trigger-switch mechanism 1340 does not need to be on firearm-handle 1327 at all, only in contact anywhere surrounding the gun.

Figure 14:
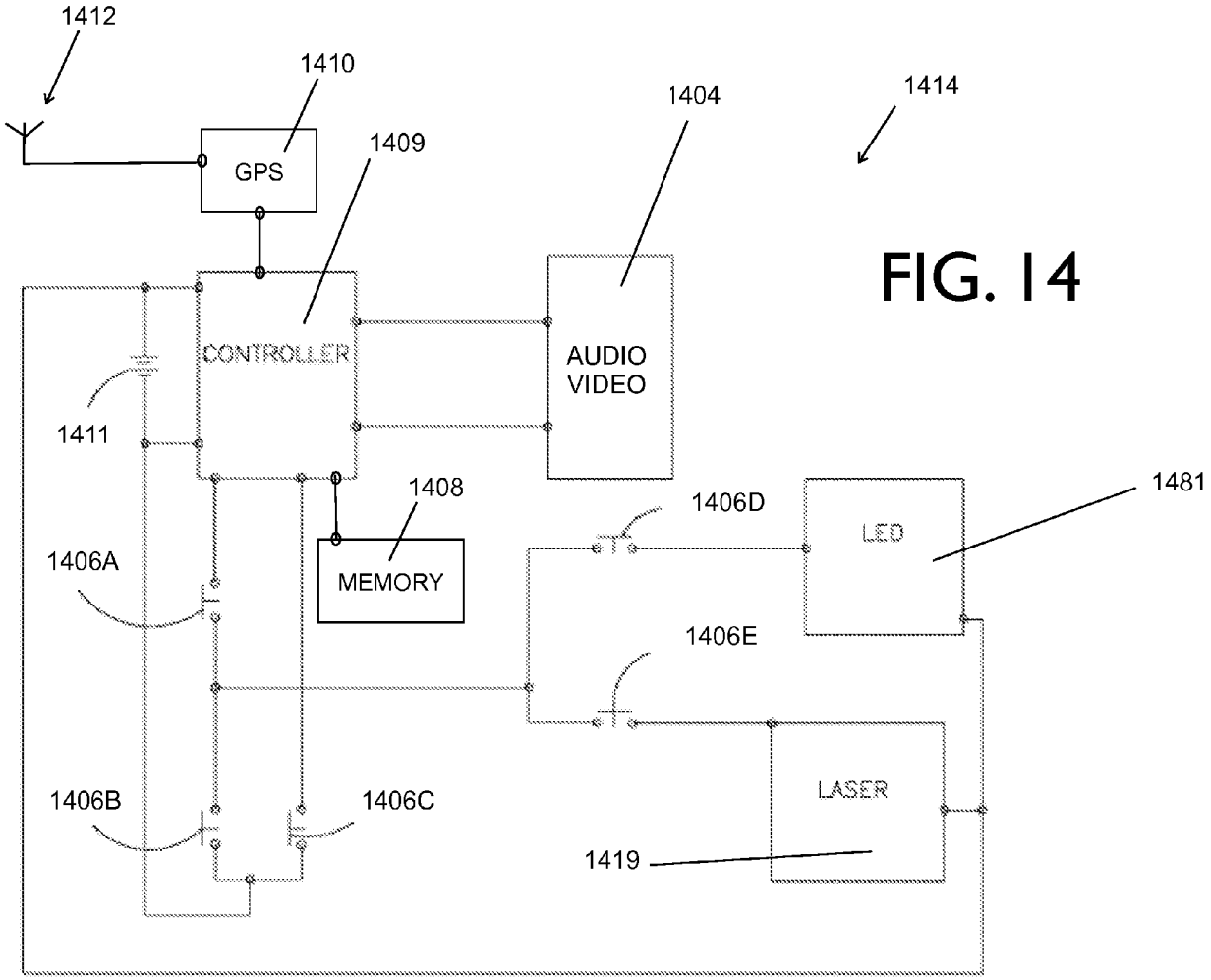
FIG. 14 is a schematic view of the circuit found within body and depicts how the electronic elements are interconnected.

FIG. 14 is a graphical view of the circuit in schematic form found within body 101 of FIG. 1. Here in FIG. 14, the circuit allows to activate each one of its components (camera 1404, laser-sight 1419, LED 1481, GPS chip 1410, memory-chip 1408 and audio-video 1404) independently. The circuit of FIG. 14 further depicts controller 1409 having control or managing the resources of the laser-sight 1419, the LED 1481, and the audio-video 1404, the GPS chip 1410 and the Bluetooth or wireless-chip 1412 as well.

The schematic of FIG. 14 further depicts battery 1411, general on/off switch 1406A, LED on/off switch 1406D, Laser on/off switch 106E, camera reset-button 1406B, and camera set button 1406C. The controller 1409, was programmed for the camera to continue recording even if the pressure switch 260 of FIG. 2, is pressed multiple times, avoiding turning off the camera accidentally. In another feature of the invention, this memorializing system 1414 is able to record save the data in a memory chip 1408 and at the same time send data and recording of a shooting in realtime via antenna chip 1412. As explained previously, the gun does not need to leave the holster for the device 1409 to start recording.

In another feature of the memorializing system 1414, is that micro-controller 1409, through antenna chip 1412, will be able to dial a telephone number or a pre-programmed list of telephones stored in the memory 1408. The memorializing system 1414, using controller 1409, will be able to dial using a voice over IP phone, using the network capabilities of antenna chip 1412. Furthermore, the micro-controller 1409 will be able to send in realtime the events of the gun, to a phone (not shown), once the trigger-switch mechanism 140 of FIG. 1 has been activated by a user. One of the phone numbers envisioned to dial automatically is "911" or local emergency operator dispatch. By dialing the "911" phone operator, the user will send wirelessly in realtime sound and video 1404, as the events are occurring.

Figure 15:
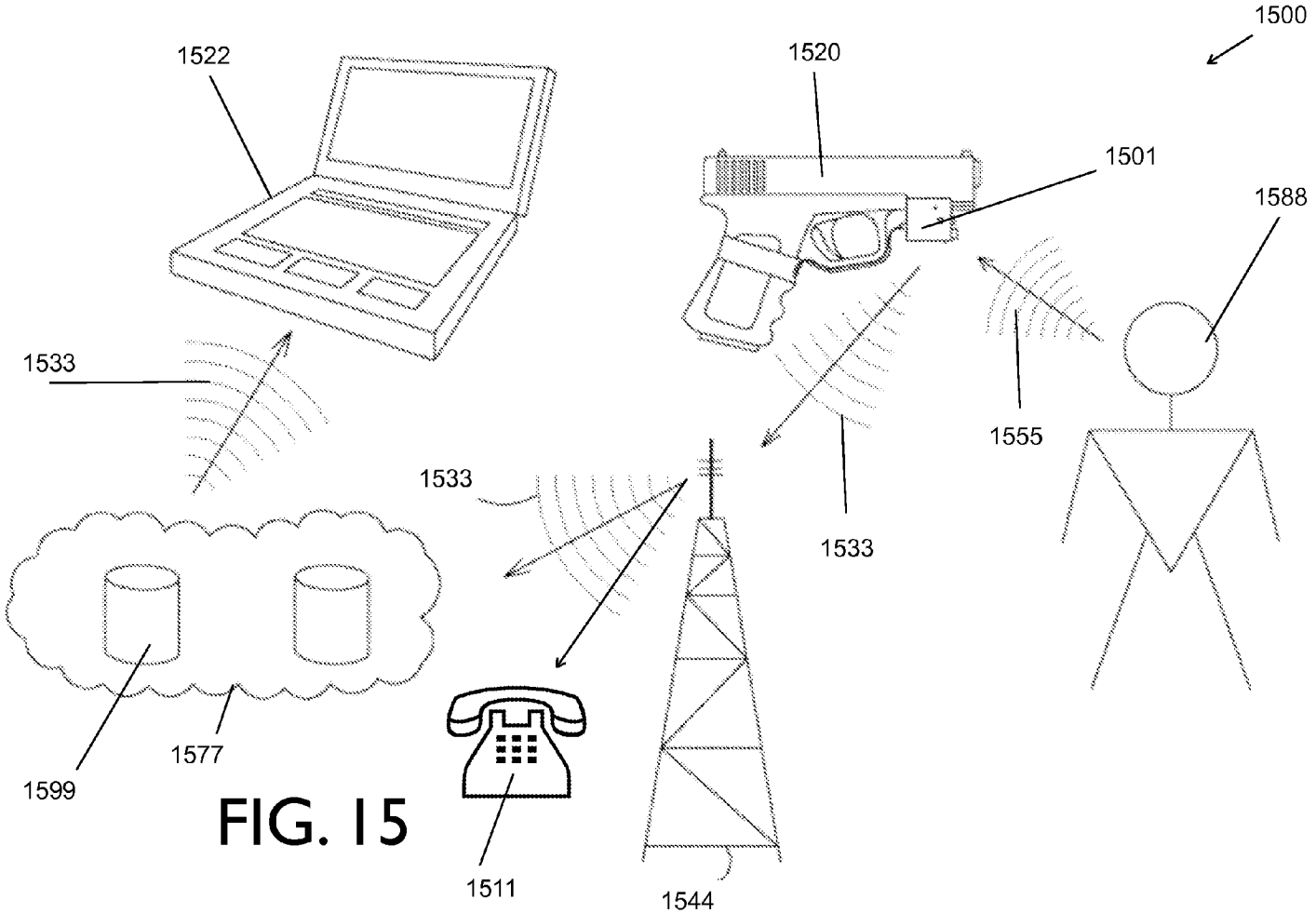
FIG. 15 is a graphical representation of the realtime memorializing system accordance to the invention herein depicting how the demountable firearm accessory communicates with a cellular tower, a telephone, and the internet; and, FIG. 16 is a graphical representation of another embodiment of the realtime memorializing system depicting how multiple demountable firearm accessories are used as part of a training system.

FIG. 15 is a graphical representation of realtime memorializing system 1500 in accordance with the invention herein. Here, firearm accessory 1501 will record environmental analog data 1555 (audio, video, GPS location, time, etc.) of the surroundings of gun 1520 and use a cellular tower 1544 to automatically transmit the recorded data 1533 (now digital data) to the internet 1577, and internet servers 1599, for later analysis. Once on the internet 1577, the data 1533 will be transmitted to a remote computer 1522 for analysis or presentation in court. This is very useful because if a user encounters an assailant 1588 he or she will have little time to act, but the information will be automatically sent and stored onto internet servers 1599 or a telephone 1511. The micro-controller (not shown) within the firearm accessory 1501 will be programmed for the automatic transmission of the data.

FIG. 15 also shows that the firearm accessory 1501 will utilize a cellular tower 1544 to transmit the recorded digitalized data 1533 to a phone 1511 as well. As explained previously, the micro-controller 1409 of FIG. 14 is able to send in realtime the events of the gun, to any phone 1511, once the trigger-switch mechanism 140 of FIG. 1 has been activated by a user. For instance, by dialing the "911" phone 1511 number, the operator will see and hear (in realtime) sound and video 1404, as the events are occurring. It is envisioned that other phone 1511 numbers include friends or family members.

Figure 16:
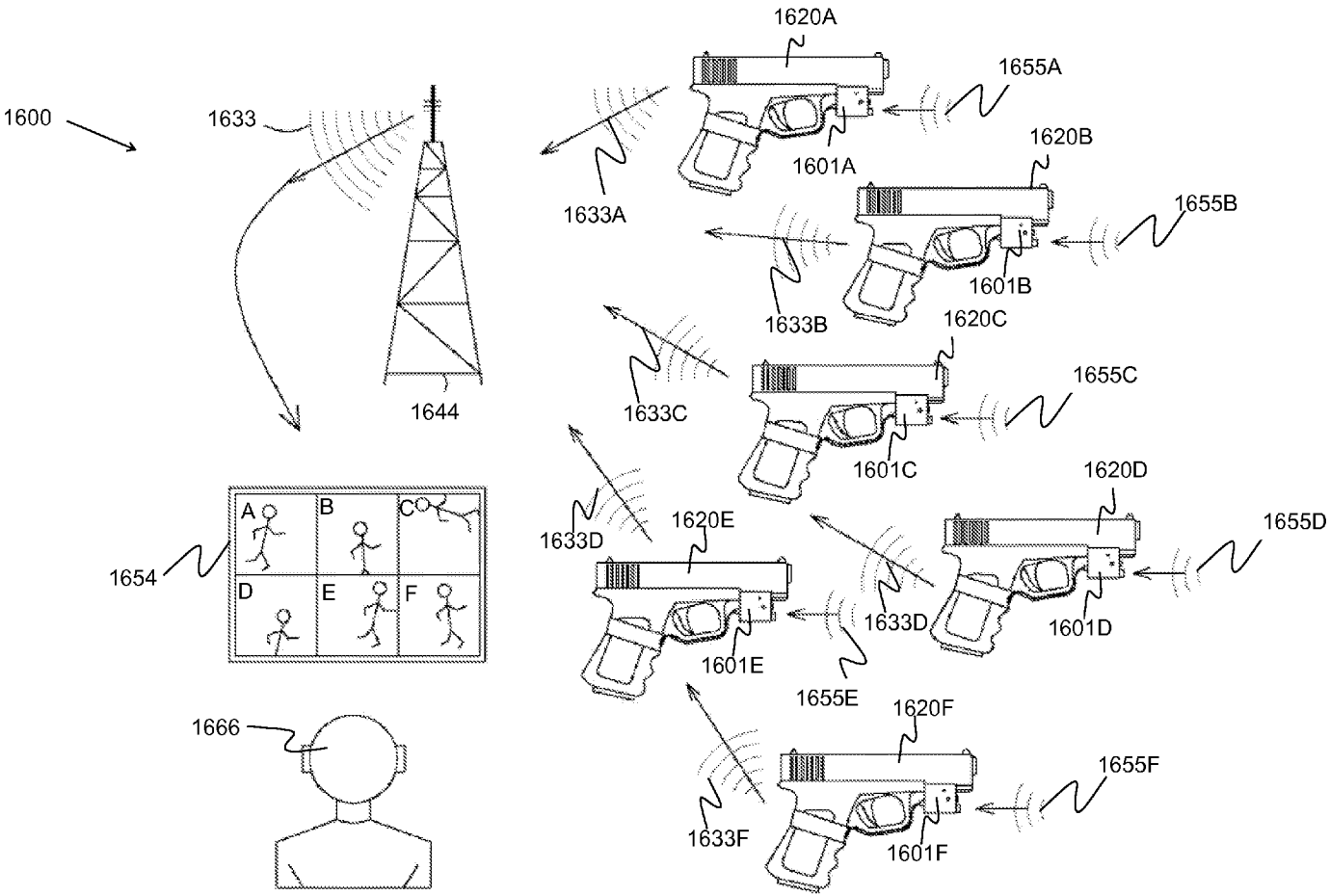

FIG. 16 is a graphical representation of realtime memorializing training system 1600 accordance to the invention herein. Here, FIG. 16 shows a system of multiple firearms 1620A-F each having a firearm accessories 1601A-E demountably attached to them. The system 1600 is intended to be used by a multitude of users at the same time. Here, all the firearms 1620A-F are part of training system 1600 which consists of using a firearm accessories 1601A-E to record the whereabouts of multiple weapons or firearms 1620A-F at the same time, transferring those whereabouts in form of data 1655A-F in realtime from the field to a trainer or coach 1666 for evaluation.

The data, once digitalized 1633A-F, will be transferred 1633 sing cellular towers 1644 to a server on the internet (not shown) for viewing on a monitor 1654 or computer. As part of a training exercise each individual feed (here shown as A, B, C, D, E, and F) will be seen in monitor 1654 simultaneously. A coach 1666 or firearm trainer will be able to see in realtime what the trainees are doing with their weapons 1620 A-F. He will then be able to communicate via radio to each individual shooter. The coach 1666 or trainer will then be able to guide the individual trainees into better target practice individually and collectively. It is also envisioned that the GPS chip inside of firearm accessories 1601A-E will also give coach 1666 the precise location of each of the trainees.

In summary, a memorializing apparatus has been presented that includes a digital recording device enclosed in a body that is demountably attached to guns e.g., pistols, revolvers, or rifles. The digital recording device allows a user to record audio, video, location, time, date, at the time of usage of a firearm. The body of the system records audio and video during day and night, onto a solid state chip within said body, to an external memory such as SD or TF memory cards, wirelessly in realtime to the internet, server, or to any phone.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

It is to be appreciated that the Detailed Description section, and not the Abstract section, is intended to be used to interpret the claims. The Abstract section may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance. The breadth and scope of the present invention should not be limited by any of the above-described exemplary embodiments, but should be defined only in accordance with the following claims and their equivalents.

We claim:

1. A firearm accessory comprising:

a body demountably attached to a firearm, the body including:

a camera;

a microphone;

a memory chip;

a micro-controller operable to:

record a user's firearm activity into the memory chip as captured by the camera and the microphone;

and, a trigger-switch mechanism demountably attached to a firearm-handle operable by a user's finger to turn the contents of the body on but not off.

2. The firearm accessory of claim 1, further comprising:

a GPS chip operable to ad location to the user's firearm activity.

3. The firearm accessory of claim 1, further comprising:

a laser sight disposed within said body.

4. The firearm accessory of claim 1, further comprising:

an LED light, the LED light disposed within said body.

5. The firearm accessory of claim 1, further comprising:

a wireless antenna chip disposed within the body.

6. The firearm accessory of claim 5 wherein:

the wireless antenna chip operable to automatically transmit the user's firearm activity over a cellular tower to a telephone.

7. The firearm accessory of claim 1 wherein:

the wireless antenna chip operable to automatically transmit the user's firearm activity over a cellular tower into a server on the internet.

8. The firearm accessory of claim 5, wherein:

the wireless antenna chip is operable to send and receive wireless signals comprising: Wifi, 802.11, MAC, Bluetooth, WLAN, and any combination thereof.

9. The firearm accessory of claim 1, wherein:

the memory chip is a removable flash memory card.

10. The firearm accessory of claim 1, wherein:

the trigger-switch mechanism is one of capacitive, resistive, mechanical, and any combination thereof.

11. The firearm accessory of claim 1, further comprising:

at least one input/output port connector.

12. A firearm memorializing apparatus comprising:

a body disposed on a firearm, the body comprising a plurality of electronic components operable to:

record audio, video, location, time, and date, at the time of usage of a firearm; and transmit the recorded a record audio, video, location, time, and date, outside of the body through a wire, a portable memory card, or wirelessly in realtime wherein, the plurality of electronic components are turned on but not off by a trigger-switch mechanism.

13. The apparatus of claim 12, wherein:

the plurality of electronic components are operable to transmit metadata, audio, GPS location, and video to a telephone using a cellular antenna.

14. The apparatus of claim 12, wherein:

the electronic components comprise: a memory comprise, a digital video camera, a digital microphone, a micro-controller, a GPS chip, a laser sight, and an LED light.

15. The apparatus of claim 12, wherein:

the portable memory card is flash memory card.

16. A method to record the events surrounding a firearm comprising the steps of:

providing an apparatus operable to:

record: audio, video, location, time, and date, at the time of usage of a firearm; and transmit the recorded audio, video, location, time, and date, outside of the body through a wire, a portable memory card, or wirelessly;

and, transmitting the recorded audio, video, location, time, and date, wirelessly using a cellular tower to a telephone and to another computer on the internet wherein, the apparatus is turned on but not off by a trigger-switch mechanism.

17. The method of claim 16, further comprising:

a laser sight and an LED light are disposed within the apparatus.

18. The method of claim 16, wherein:

the trigger-switch mechanism is one of capacitive, resistive, mechanical, and any combination thereof.

* * * * *